United States Patent [19]

Sze

[11] 4,316,793

[45] Feb. 23, 1982

[54] HYDROLIQUEFACTION OF COAL

[75] Inventor: Morgan C. Sze, Upper Montclair, N.J.

[73] Assignee: The Lummus Company, Bloomfield, N.J.

[21] Appl. No.: 106,273

[22] Filed: Dec. 21, 1979

[51] Int. Cl.[3] ..... C10G 1/06; B01J 8/18

[52] U.S. Cl. ..... 208/10; 422/140; 422/141; 422/142

[58] Field of Search ..... 208/10; 422/140, 141, 422/142

[56] References Cited

U.S. PATENT DOCUMENTS

| | | | |
|---|---|---|---|
| 3,644,192 | 2/1972 | Le et al. | 208/8 |
| 3,700,584 | 10/1972 | Johanson et al. | 208/10 |
| 3,769,198 | 10/1973 | Johanson et al. | 208/10 |
| 3,957,619 | 5/1976 | Chun et al. | 208/10 |
| 4,045,329 | 8/1977 | Johanson et al. | 208/10 |

*Primary Examiner*—Delbert E. Gantz
*Assistant Examiner*—William G. Wright
*Attorney, Agent, or Firm*—Louis E. Marn; Elliot M. Olstein

[57] ABSTRACT

Coal is catalytically hydroliquefied by passing coal dispersed in a liquefaction solvent and hydrogen upwardly through an expanded catalyst bed in a stream having a cross-sectional flow area of no greater than 255 inches square, with the stream through the catalyst bed having a length and a liquid and gas superficial velocity to maintain an expanded catalyst bed and provide a Peclet Number of at least 3. If recycle is employed, the ratio of recycle to total feed (coal and liquefaction solvent) is no greater than 2:1 based on volume. Such conditions provide for improved selectivity to liquid product to thereby reduce hydrogen consumption.

16 Claims, 1 Drawing Figure

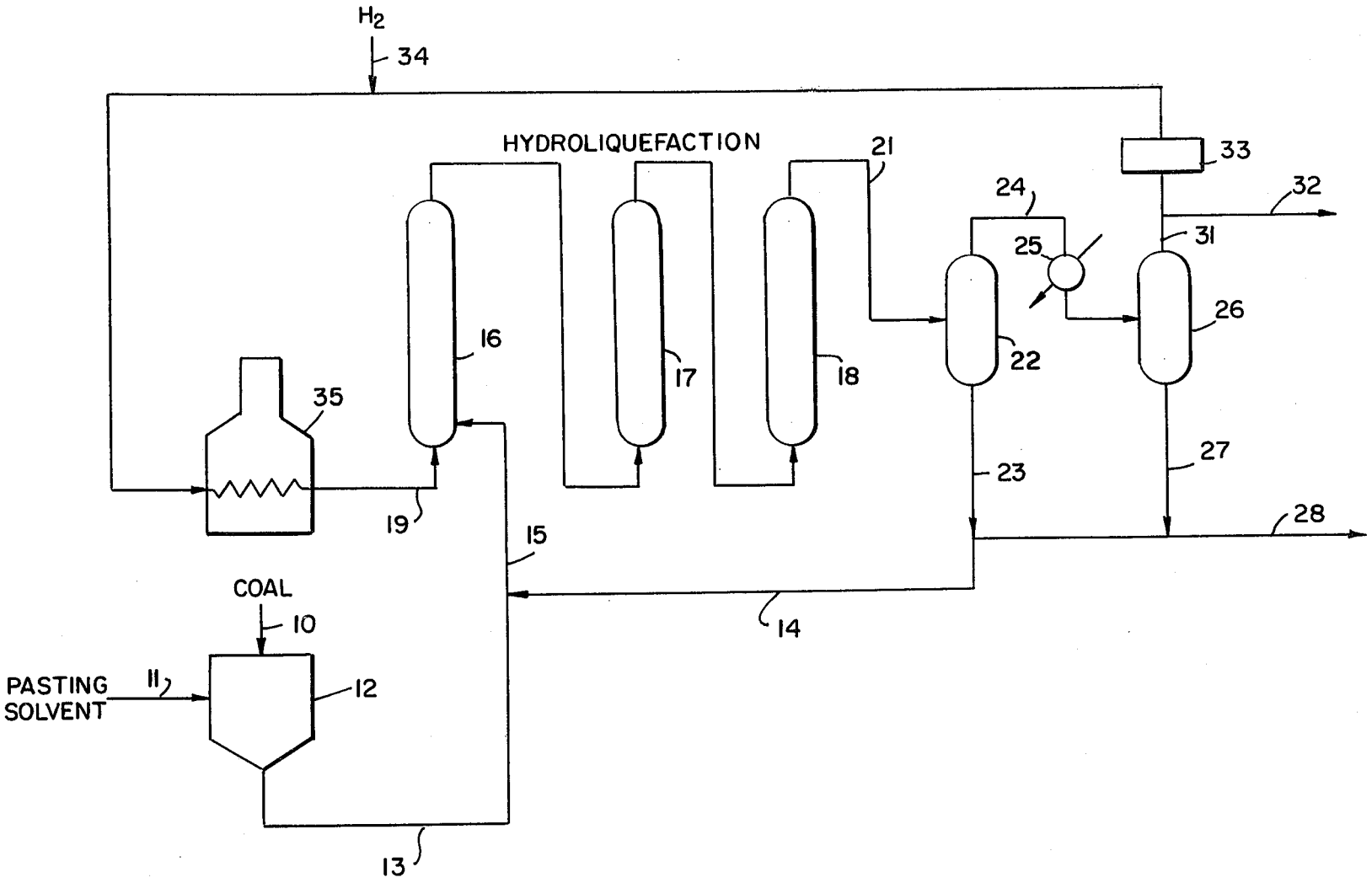
32
28
33
31
26
27
24
25
22
23
21
18
14
HYDROLIQUEFACTION
17
15
16
$H_2$
34
19
13
35
12
COAL
10
11
PASTING SOLVENT

HYDROLIQUEFACTION OF COAL

This invention relates to the hydroliquefaction of coal.

Hydroliquefaction of coal to valuable liquid products is currently of great interest. In one such process, coal dispersed in a suitable liquefaction solvent is hydroliquefied in an upflow expanded or ebullated hydroliquefaction catalyst bed. Such a process is described, for example, in U.S. Pat. No. 2,987,465.

Applicant has found that such an upflow expanded or ebullated bed hydroliquefaction process has poor selectivity to liquid products, whereby there is an inefficient use of hydrogen and the production of substantial amounts of light products, such as methane, ethane, propane, butane and light oils boiling below 400° F. Such products contain a higher percentage of hydrogen than heavier distillates.

In accordance with the present invention, applicant has provided a new and improved process and system for the hydroliquefaction of coal in an upflow expanded or ebullated catalyst bed which increases the selectivity to liquid products and thereby efficiently uses its hydrogen to provide a more economical process.

In accordance with one aspect of the present invention, there is provided a process for the catalytic hydroliquefaction of coal by passing coal dispersed in a coal liquefaction or pasting solvent and hydrogen through at least one upflow expanded catalyst bed in a stream having a cross-sectional flow area of no greater than 255 square inches, with the stream through the catalyst bed having a length and a gas and liquid superficial velocity to maintain an expanded bed and provide a Peclet Number of at least 3. If recycle is employed, the ratio of recycle to total feed (coal and liquefaction solvent) does not exceed 2:1, by volume.

In accordance with another aspect of the present invention, there is provided a reaction system for the catalytic hydroliquefaction of coal which includes at least two upflow expanded or ebullated bed catalytic reaction zones in series, each of which includes an expanded catalyst bed providing for flow therethrough in a stream which has a cross-sectional flow area of no greater than 255 square inches and a flow length whereby the superficial velocities of gas and liquid through the reaction zones maintain the expanded or ebullated catalyst bed and provide a Peclet Number of at least 3.

Peclet Number is defined as follows:

$$\text{Peclet No.} = \frac{(V_L)(L)}{(73.5\text{hr.} - \tfrac{1}{2})(1 - E_G)(D)^{1.5}(V_G)^{0.5}}$$

wherein $V_L$ is liquid velocity, ft/hr.

L is length of reactor, ft.

D is the equivalent diameter of the catalyst reaction zone $V_G$ is the gas velocity, ft/hr $E_G$ is the fraction of the total catalyst bed volume which is occupied by the gas, as disclosed by Hughmark, G. A., "Hold-Up and Mass Transfer in Bubble Columns" *I&EC Process Design and Development*, 6" (2), pp 218–220, 1964.

Peclet Number is a measure of the approach to plug flow, with a Peclet Number of infinity corresponding to perfect plug flow. In accordance with the present invention, the higher the Peclet Number the better the hydrogen efficiency, and as a result, although a Peclet Number of at least 3 provides a beneficial increase in hydrogen efficiency, the Peclet Number should preferably be as high as possible, consistent with other reaction conditions. Thus, the Peclet Number is preferably at least 3, and most preferably at least 10. The Peclet number is preferably as high as possible; however, as a result of design limitations the Peclet number generally does not exceed 70, and in most cases does not exceed 50. The selection of an optimum Peclet Number for a particular feedstock and other designs considerations should be apparent to those skilled in the art from the teachings herein.

The cross-sectional flow area of the stream in the catalyst bed is no greater than 255 square inches, with the cross-sectional flow area generally being at least 10 square inches. In most cases, the cross-sectional flow area is at least 28 square inches. The selection of an optimum cross-sectional flow area will vary, and the selection of such an optimum cross-sectional flow area is deemed to be within the scope of those skilled in the art from the teachings herein.

The other parameters included in the calculation of Peclet Number are reaction zone length and superficial gas and liquid velocities through the expanded catalyst bed. The velocity of gas and liquid through the bed must be at a value sufficient to maintain the ebullated or expanded catalyst bed state, and as a practical manner, such expansion is primarily related to the superficial liquid velocity. Thus, the reactor length and the superficial liquid and gas velocities are coordinated to provide a Peclet Number, as hereinabove described, as well as sufficient velocity to provide for the expanded or ebullated catalyst bed. In general the reaction zone length is in the order of from 20 to 130 feet, and most preferably in the order of from 40 to 90 feet, with the superficial liquid velocity generally being in the order of from 0.04 to 0.3 foot per second. The superficial gas velocity is generally in the order of from 0.04 to 1 foot per second. The selection of optimum values is deemed to be within the scope of those skilled in the art from the teachings herein.

In accordance with the invention, recycle is limited, with the ratio of recycle to total feed (coal and liquefaction solvent) being no greater than 2:1. Although in some cases it may be possible to operate the process without any recycle; i.e., a recycle ratio of 0:1, in most cases, some recycle is required in order to maintain a sufficient liquid velocity for expanding the catalyst bed. As a result, in most cases, the recycle ratio is at least 0.2:1, with the recycle ratio generally not exceeding 1:1. In accordance with the preferred embodiment, all of such recycle is provided externally; i.e., no internal recycle, which thereby eliminates the necessity for an internal recycle pump as generally employed in the ebullated bed coal liquefaction process. It is to be understood, however, that it is possible within the scope of the invention to provide some internal recycle, provided that the recycle ratio (internal and/or external recycle) does not exceed 2:1.

In accordance with a preferred embodiment of the present invention, there are at least two catalytic hydroliquefaction zones of the type hereinabove described in series, and preferably at least three such zones in series. The additional hydroliquefaction zones are employed to provide the desired hydroliquefaction without an unacceptable increase in temperature; i.e., the exothermic heat of reaction is controlled by providing a series of reaction zones, rather than by providing large quantities of recycle. The selection of an optimum amount of reaction zones, in series, is deemed to be within the scope of those skilled in the art from the teachings herein. In most cases, it is not necessary to provide any more than 4 of such hydroliquefaction zones in series. In most cases, the number of hydroliquefaction zones in series is selected to limit the temperature increase of each of the zones to no greater than 150° F., and preferably to no greater than 100° F.

The hydroliquefaction, as known in the art, is conducted at elevated temperatures and pressures. In general, the hydroliquefaction temperature is in the order of 650° F. to 900° F., and preferably from 750° F. to 850° F. The pressures are generally in the order of from 1800 to 3000 psig, and most generally in the order of from 2000 to 2700 psig. The selection of optimum temperatures and pressures are deemed to be within the scope of those skilled in the art from the teachings herein.

Hydrogen is introduced into the hydroliquefaction zone in an amount, which when coordinated with the other processing conditions, provides an amount of hydrogen addition or absorption to provide the desired liquefied product. In addition, hydrogen is provided for effecting hydrodesulfurization and hydrodenitrification of the feedstock. In general, by proceeding in accordance with the present invention, it is possible to achieve a conversion of 90% or more of the MAF coal feed with hydrogen consumptions in the order of from 2 to 4 lbs. of hydrogen per 100 lbs. of coal.

The hydroliquefaction is conducted with a catalyst suitable for liquefying the coal, and in addition, such catalyst should have desulfurization and denitrification activity. Such catalysts are generally known in the art; e.g., cobalt molybdate, nickel molybdate, tungsten-nickel sulfide, etc., and are generally supported on a suitable support such as alumina. The selection of a suitable catalyst is deemed to be within the scope of those skilled in the art from the teachings herein.

The catalyst is maintained in the hydroliquefaction zone as an expanded or ebullated bed. As known in the art, such expanded or ebullated bed differs from a fluidized bed in that, in the expanded or ebullated bed, catalyst particles are not maintained in fluidized random motion. Such expanded or ebullated beds are known in the art, and as a result, no further details in this respect are deemed necessary for a complete understanding of the present invention.

The coal, as known in the art, is dispersed in a suitable pasting or coal liquefaction solvent or oil for passage through the catalytic hydroliquefaction zone. Such pasting or liquefaction solvents are known in the art, and is preferably a solvent derived from the coal liquefaction product, although other pasting solvents or oils may also be employed for the hydroliquefaction. The selection of a particular pasting oil is well within the scope of those skilled in the art, and forms no part of the present invention. In general, as known in the art, the pasting solvent is provided in an amount to provide a pasting solvent to coal weight ratio in the order of those generally used in the art; e.g., from 1:1 to 20:1.

The coal employed as a hydroliquefaction feed may be a bituminous coal, sub-bituminous coal or a lignitic coal. The selection of a suitable coal for producing a desired product forms no part of the present invention, and as a result no further details in this respect are deemed necessary for a complete understanding thereof.

The invention will be further described with respect to the accompanying drawing, wherein:

The drawing is simplified schematic flow diagram of an embodiment of the present invention.

It is to be understood that the embodiment is only schematically shown, and various equipment, such as pumps, heat exchangers and the like have been omitted for simplifying the description of the embodiment. The use of such equipment at suitable places is well within the scope of those skilled in the art from the teachings herein.

Referring now to the drawing, coal in line 10 and a suitable pasting solvent in line 11, generally recovered from the hydroliquefaction product, are introduced into a slurry tank 12 to disperse the coal in the pasting solvent. A slurry of coal in pasting solvent is withdrawn from tank 12 through line 13, combined with recycle in line 14, as hereinafter described, and the combined stream in line 15 is introduced into the first of three hydroliquefaction reactors 16, 17 and 18, respectively. Heated hydrogen in line 19 is also introduced into the first of the three hydroliquefaction reactors 16, 17 and 18.

Each of the hydroliquefaction reactors 16, 17 and 18 includes an expanded or ebullated bed of hydroliquefaction catalyst, and such reactors are designed and operated to provide for upward flow of hydrogen and coal dispersed in solvent through the bed as a stream having a cross-sectional flow area through the catalyst of no greater than 255 square inches, and a Peclet Number of at least 3. Reactors 16, 17 and 18 are operated without any internal recycle. Thus, as hereinabove described, the length of each of the catalyst beds as well as the liquid and gas superficial velocities are coordinated with the stream cross-sectional flow area through the catalyst to provide a Peclet Number of at least 3. The hydroliquefaction reactors 16, 17 and 18 are operated at the temperatures and pressures hereinabove described to effect hydroliquefaction of the coal, and in addition, hydrodesulfurization and hydrodenitrification thereof. The coal dispersed in the pasting solvent, as well as the hydrogen, flows serially through the expanded hydroliquefaction catalyst beds in reactors 16, 17 and 18, with the hydroliquefaction effluent being withdrawn from reactor 18 through line 21.

The effluent in line 21 is introduced into a gas-liquid separator 22 to recover a portion of the liquid product in line 23, with the remaining portion of the effluent in line 24 being passed through a suitable cooler 25 and introduced into a second separator 26 to recover further liquid product through line 27. The net hydroliquefaction product is recovered through line 28 for further treatment, as known in the art.

Recycle product is recovered through line 14, and as hereinabove note, the recycle in line 14 is primarily for the purpose of providing sufficient liquid in the hydroliquefaction reactors 16, 17 and 18 to maintain the catalyst as an expanded bed. The recycle amounts are limited as hereinabove described.

Gas is recovered from separator 26 through line 31 and a portion thereof is purged through line 32. The remaining portion is compressed in compressor 33, combined with make-up hydrogen in line 34 and the combined stream passed through a suitable heater 35 to provide heated hydrogen to the hydroliquefaction through line 19.

The hereinabove described embodiment is only illustrative of the present invention, and as a result, such an embodiment may be modified within the spirit and the scope of the present invention. Thus, the hydroliquefaction may be effected in more or less than three zones, as particularly described. Similarly, product recovery may be effected other than as particularly described.

These and other modifications should be apparent to those skilled in the art from the teachings herein.

The invention will be further described with respect to the following Example; however, the scope of the invention is not to be limited thereby:

EXAMPLE

The hydroliquefaction is conducted by the use of two reactors in series, each of which has a nominal diameter of 1 inch and a length of 10 feet. Each of the reactors includes a catalyst of cobalt molybdate supported on alumina.

The hydroliquefaction conditions are used for the hydroliquefaction of Illinois No. 6 Coal.

Feed Coal Content, wt. % 33.5
Reaction Temperature, °F. 780–820
Reaction Pressure, psig. 1400
Liquid Feed velocity, ft/hr 116
Gas Feed velocity, ft/hr 1513
Peclet Number 20
Reaction Stages per Reactor 10
Hydrogen consumption, wt. % of (1) coal feed 3.7
Sulfur content of ash free liquefaction product, wt. % 0.45

(1) The coal liquefaction solvent was not equilibrated and some of the hydrogen consumption is attributable to reaction with liquefaction solvent.

The present invention is particularly advantageous in that there is provided improved selectivity to liquid product which increases overall hydrogen efficiency. As a result, the present process is more economic than the hydroliquefaction processes previously employed in the art.

Thus, by proceeding in accordance with the invention it is possible to achieve a 90% or greater conversion of moisture ash free (MAF) coal with hydrogen consumptions of 2–4 lbs. hydrogen per 100 lbs. coal, as compared to previous hydrogen consumptions in excess of 4%, and in most cases in excess of 4.5%.

These and other advantages should be apparent to those skilled in the art from the teachings herein.

Numerous modifications and variations of the present invention are possible in light of the above teachings and, therefore, within the scope of the appended claims, the invention may be practised otherwise than as particularly described.

I claim:

1. A process for the catalytic hydroliquefaction of coal, comprising:

catalytically hydroliquefying the coal by passing the coal dispersed in a coal liquefaction solvent and hydrogen upwardly through an expanded hydroliquefaction catalyst bed in a stream having a cross-sectional flow area of no greater than 255 square inches, said stream through the catalyst bed having a length and a liquid and gas superficial velocity to maintain an expanded catalyst bed and provide a Peclet Number of at least 3, said hydroliquefaction being effected with a ratio of hydroliquefaction product recycle to total hydroliquefaction feed of from 0:1 to 2:1.

2. The process of claim 1 wherein the Peclet Number is at least 10.

3. The process of claim 1 wherein the cross-sectional flow area is at least 10 square inches.

4. The process of claim 3 wherein the cross-sectional flow area is at least 28 square inches.

5. The process of claim 3 wherein the hydroliquefaction is effected by passage through at least two expanded liquefaction catalyst beds in series, and in each of said at least two catalyst beds in series, said stream has a cross-sectional flow area of no greater than 255 square inches, and a length and a liquid and gas superficial velocity to maintain an expanded catalyst bed and provide a Peclet Number of at least 3.

6. The process of claim 5 wherein the hydroliquefaction is effected with sufficient catalyst beds in series, to limit the temperature increase in each of the catalyst beds to no greater than 150° F.

7. The process of claim 3 wherein the hydroliquefaction is effected without internal recycle to the catalyst bed.

8. The process of claim 1 wherein the total hydrogen consumption for the hydroliquefaction is from 2 to 4 lbs. of hydrogen per 100 lbs. of coal to achieve at least 90% conversion of moisture ash free coal.

9. The process of claim 8 wherein the ratio of hydroliquefaction product recycle to total hydroliquefaction feed is from 0.2:1 to 1:1.

10. The process of claim 8 wherein the hydroliquefaction is effected at a temperature of from 650° F. to 900° F. and a pressure of from 1800 to 3000 psig.

11. The process of claim 5 wherein the hydroliquefaction is effected without internal recycle to the catalyst beds, and the hydrogen consumption for the hydroliquefaction is from 2 to 4 lbs. of hydrogen per 100 lbs. of coal to achieve at least 90% conversion of moisture ash free coal.

12. A system for the catalytic hydroliquefaction of coal in an expanded catalyst bed, comprising:

at least two reactors connected in series, each of said reactors including an expanded catalyst bed providing for flow therethrough in a stream having a cross-sectional flow area of no greater than 255 square inches and a flow length whereby the superficial velocities of gas and liquid maintain said expanded catalyst bed and provide a Peclet Number of at least 3.

13. The system of claim 12 wherein the cross-sectional flow area is at least 10 square inches.

14. The system of claim 13 wherein the cross-sectional flow area is at least 28 square inches.

15. The system of claim 13 wherein the Peclet Number is at least 10.

16. The system of claim 13 wherein each of said reactors is free of means for providing internal recycle to the catalyst bed.

* * * * *